US005169087A

United States Patent [19]

Romagnoli

[11] Patent Number: 5,169,087

[45] Date of Patent: Dec. 8, 1992

[54] COOPERATING TUBE CONSTRUCTION FOR DYEING REELS

[75] Inventor: Tiziano Romagnoli, Prato, Italy

[73] Assignee: Mariplast S.p.A., Florence, Italy

[21] Appl. No.: 739,874

[22] Filed: Aug. 2, 1991

[30] Foreign Application Priority Data

Aug. 23, 1990 [IT] Italy ..... 11667/90[U]

[51] Int. Cl.[5] ..... B65H 75/18; B65H 75/20; B65H 75/28

[52] U.S. Cl. ..... 242/118.1; 242/118.3

[58] Field of Search ..... 242/118.1, 118.11, 118.3, 242/118.31, 118.32; 68/189, 198

[56] References Cited

U.S. PATENT DOCUMENTS 4,702,433 10/1987 Gilljam et al. ..... 242/118.1

4,997,141 3/1991 Pasini ..... 242/118.1

*Primary Examiner*—Stanley N. Gilreath

*Attorney, Agent, or Firm*—McGlew and Tuttle

[57] ABSTRACT

One of the ends (X) of a tube has an internal annular ledge (7) and an annular wall (9), the internal surface (9A) of which forms an annular corner (10) around the ledge (7) and widens slightly as it moves away from the ledge; the other end (Y) forms a setback (12) towards the inside followed by an approximately cylindrical collar (14) for the turns of reserve yarn, the annular edge (14A) of which is capable of bearing against a ledge (7) as described above, of a similar tube and of being centered by an annular corner (10) as described above, of a similar tube; said annular edge (14A) has hollows (16) which are capable of allowing the passage of fluid which thus acts on the turns of the reserve.

6 Claims, 1 Drawing Sheet

COOPERATING TUBE CONSTRUCTION FOR DYEING REELS

SUMMARY OF THE INVENTION

The invention relates to a tube for dyeing reels, with a cribrous wall, on which is wound the yarn to a cop or reel; each of the annular ends of the tube—which is essentially cylindrical—is capable of interacting with the opposite end of a similar tube which is adjacent in the arrangement on a guide column of a dyeing or other device. Usually, one of the ends is shaped with an external annular channel for a plurality of turns of reserve yarn. The tube according to the invention is capable of ensuring that even these turns are subjected to regular dyeing. Other aims and advantages will emerge from the text which follows.

According to the invention, one of the ends of the tube has an internal annular ledge and an annular wall, the internal surface of the annular wall forms an annular corner around the ledge and widens slightly as it moves away from the ledge the other end of the tube forms a setback toward the inside followed by an approximately cylindrical collar, the annular edge of the cylindrical collar is capable of bearing against said ledge, as described above, of a similar tube and of being centered by an annular corner, as described above, of a similar tube; said annular edge has hollows which are capable of allowing passages for fluid which flows between said annular wall and said approximately cylindrical collar, and between the edge of said annular wall and said setback, as a result of which it is possible to dye the turns of reserve yarn, which are wound on said cylindrical collar.

Said annular wall can form externally an annular channel which is itself also capable of receiving turns of reserve yarn; said annular channel can have projections transverse to it, which are capable of facilitating the taking of the reserve yarn.

The hollows of the annular edge of the cylindrical collar can be formed by depressions forming slots along the annular ledge.

BRIEF DESCRIPTION OF THE DRAWINGS

The drawing shows a possible embodiment of the invention and in particular.

DETAILED DESCRIPTION OF THE PREFERRED EMBODIMENT

Figure 1:
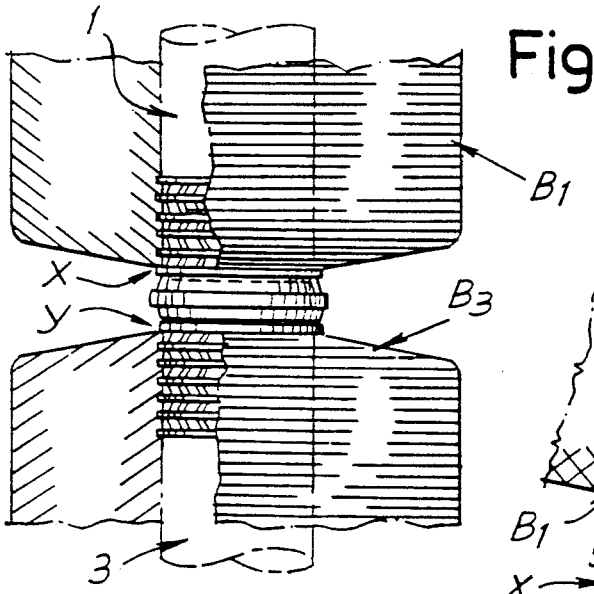
FIG. 1 is a schematic view of the device of the invention.
Figure 2:
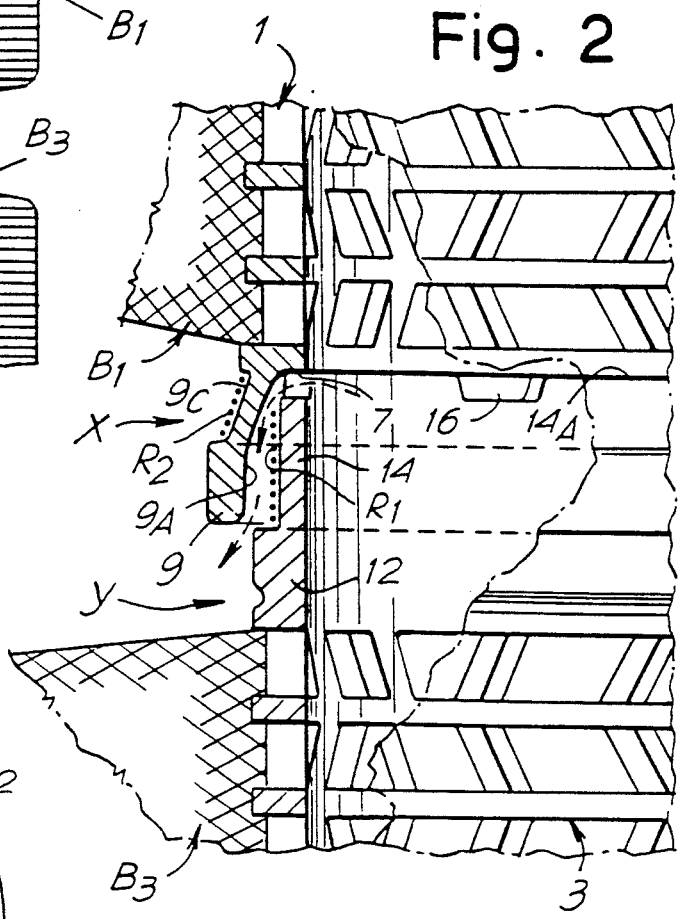
FIGS. 2 and 3 show in cross-section two interacting ends, connected and separated respectively.
Figure 4:
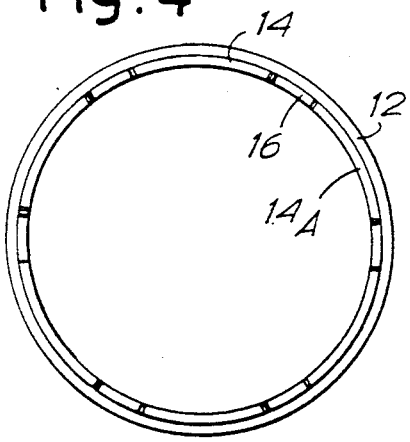
FIG. 4 shows a diagrammatic plan view.
Figure 3:
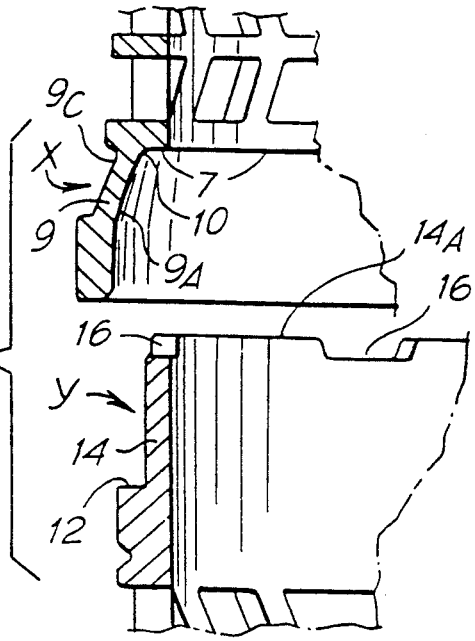

According to what is illustrated in the attached drawing, 1 and 3 indicate two adjacent and like tubes which are assembled axially on one and the same column of a device for dyeing, each tube comprising a reel or cop B1 and B3 respectively which is to be dyed with liquid which passes through the cribrous walls of the tubes and through the mass of the wound material. The two ends of each tube are shaped in order to interact and to receive, one or the other without distinction or both, a reserve of yarn and to ensure, in particular on the upper reduced end of a tube, the action of the dye on the turns of the reserve also.

According to what is illustrated in the drawing, one of the ends X, considered lower in the drawing itself, has an internal annular ledge 7 and an annular wall 9, the internal surface 9A of which forms an annular corner 10 around the ledge 7 and widens gradually in relation to the diameter of the corner 10.

The other end Y, being the upper end in the drawing, has a setback 12 towards the inside and an essentially cylindrical collar 14 which extends from said setback 12, forming an annular edge 14A, the external corner of which has a diameter which corresponds to that of the corner 10 of the end X of the corresponding tube; the annular edge 14A has hollows 16 distributed essentially in a uniform manner along the edge itself, for the purposes indicated below.

The external surface of the collar 14 and, respectively, a channel 9C formed outside the wall 9 each form seats which can receive a series of turns of reserve yarn indicated respectively by R1 and R2, it being possible to form the reserve turns alternately or simultaneously on one and on the other of said seats in the formation of the reels or cops such as B1 and B3. The channel 9C is provided with transverse projections to facilitate support of reserve yarn R2.

When two tubes are connected to one another axially, the collar 14 penetrates into the inside of the wall 9 and its edge 14A is centered by the corner 10 on the ledge 7, against which the edge 14A bears. With the bearing of the edge 14A against the ledge 7, passages are defined between the two tubes, defined by the hollows 16 which can be formed on said edge 14 but alternatively in equivalent manner can also be created by projections formed in said ledge 7 for the bearing of the edge 14A. The hollows 16 are advantageously shallow and extended in the circumferential direction so as to have a substantial distribution of the said apertures along the circumference of connection between the two tubes. In the connection between the two tubes, the collar 14 and the internal surface 9A of the wall 9 leave an interspace which develops from the passages formed by the hollows 16 as far as the setback 12, leaving a space between said setback and the wall 9. It is thus possible to ensure a circulation of liquid in the zone comprised between the collar 14 and the wall 9 and therefore in the region of the turns of the reserve yarn R1. The two tubes are centered in relation to one another by the interaction of the edge 14A with the corner 10 of the ledge 7.

The cribrous cylindrical wall of the tubes is made in one of the ways already discussed in detail in U.S. Pat. No. 4,793,568 and U.S. patent application Ser. No. 07/669,112.

I claim:

1. A cooperating tube construction, comprising:

a first tube having a cribrous wall, a first tube first end and a first tube second end;

a second tube having a second tube first end and a second tube second end, each of said first tube first end and said second tube first end including an internal annular ledge and an annular wall connected to said internal annular ledge, said annular wall extending axially outwardly from said annular ledge and radially outwardly from said annular ledge, said annular wall having an internal surface cooperating with said annular ledge to form an annular corner, each of said first tube second end and said second tube second end including a setback portion connected to a substantially cylindrical collar, said substantially cylindrical collar having an annular edge, one of said first tube first end and said second tube first end cooperating with one of said first tube second end and said second tube second end to form engaged tubes with said annular edge bearing against said annular edge with said annular edge being centered by said annular corner, said annular edge cooperating with said annular ledge to form passage opening allowing passage of fluid from an inner side of the engaged tubes to an outer side of the engaged tubes, said internal surface of said annular wall cooperating with said cylindrical collar and said setback tq define a continuous gap from said passage openings to a terminal end of said annular wall, adjacent said setback, said cylindrical collar defining a support for reserve yarn allowing said reserve yarn to be dyed by dye fluid passing through said openings and through said continuous gap.

2. A cooperating tube construction according to claim 1, wherein said annular wall defines an annular channel, on an external surface of said annular wall, said annular channel for receiving turns of reserve yarn.

3. A cooperating tube construction according to claim 1, wherein said gap is an annular gap extending circumstantially, uninterrupted, around said cylindrical collar.

4. A cooperating tube construction according to claim 1, wherein said passage openings are formed by depressions defining slots in said annular edge of said cylindrical collar.

5. A cooperating tube construction according to claim 1, wherein said passage openings and said gap cooperate to define a circulation connection for circulating fluid dye between an exterior of said engaged tubes and an interior of said engaged tubes.

6. A cooperating tube construction comprising:

a first tube having a first tube first end and a first tube second end;

a second tube having a second tube first end and a second tube second end, each of said first tube first end and said second tube first end including an internal annular ledge and an annular wall connected to said internal annular ledge, said annular wall extending axially outwardly from said annular ledge and radially outwardly from said annular ledge, said annular wall having an internal surface cooperating with said annular ledge to form an annular corner, each of said first tube second end and said second tube second end including a setback portion connected to a substantially cylindrical collar, said substantially cylindrical collar having an annular edge, one of said first tube first end and said first tube second end cooperating with one of said first tube second end and said second tube second end to form engaged tubes with said annular edge bearing against said annular ledge with said annular edge being centered by said annular corner, said annular edge cooperating with said annular ledge to form passage openings allowing passage of fluid from an inner side of the engaged tubes to an outer side of the engaged tubes, said internal surface of said annular wall cooperating with said cylindrical collar and said setback to define a continuous gap from said passage openings to a terminal end of said annular wall, adjacent said setback, said gap being annular extending circumferentially around said cylindrical collar, said cylindrical collar defining a support for reserve yarn allowing said reserve yarn to be dyed by dye fluid passing through said openings and through said continuous gap.

* * * * *